US005174210A

United States Patent [19]

Rodi et al.

[11] Patent Number: 5,174,210

[45] Date of Patent: Dec. 29, 1992

[54] PREPARATION OF THE INKING UNIT OF A PRINTING PRESS FOR A CHANGE OF PRINTING JOB

[75] Inventors: Anton Rodi, Leiman; Bernd Müller, Nussloch, both of Fed. Rep. of Germany

[73] Assignee: Heidelberger Druckmaschinen Aktiengesellschaft, Heidelberg, Fed. Rep. of Germany

[21] Appl. No.: 693,233

[22] Filed: Apr. 26, 1991

Related U.S. Application Data

[63] Continuation-in-part of Ser. No. 540,612, Jun. 10, 1990, Pat. No. 5,081,926.

[30] Foreign Application Priority Data

Apr. 27, 1990 [DE] Fed. Rep. of Germany ..... 4013463

[51] Int. Cl.[5] ..... B41F 7/06; B41F 7/26; B41F 31/10

[52] U.S. Cl. ..... 101/492; 101/148

[58] Field of Search ..... 101/142, 144, 145, 136, 101/137, 140–148, 349–352, 492, 483, 211, 232, 207–210

[56] References Cited

U.S. PATENT DOCUMENTS

| | | | |
|---|---|---|---|
| 3,056,346 | 10/1962 | Gammeter et al. | 101/144 |
| 3,771,446 | 11/1973 | Kaneko et al. | 101/144 |
| 4,434,176 | 3/1984 | Ishii et al. | 101/144 |
| 4,660,470 | 4/1987 | Kramp et al. | 101/426 |

FOREIGN PATENT DOCUMENTS 2202490 9/1988 United Kingdom .

*Primary Examiner*—J. Reed Fisher
*Attorney, Agent, or Firm*—Nils H. Ljungman and Associates

[57] ABSTRACT

The invention relates to a rotary printing press, particularly offset printing press, the printing unit of which comprises a printing form, a damping unit as well as an inking unit, said inking unit being provided with a set ink profile. In order to obtain a fast change of ink profile, it is proposed that, in order to eliminate the previous ink profile and to prepare the buildup of a new ink profile, the printing form 32 is inked over its entire surface area with the inking unit 1.

17 Claims, 10 Drawing Sheets

PREPARATION OF THE INKING UNIT OF A PRINTING PRESS FOR A CHANGE OF PRINTING JOB

This application is a continuation-in-part of U.S. application Ser. No. 07/540,612, now U.S. Pat. No. 5,081,926, entitled "Method and Apparatus for the Rapid Establishment of an Ink Zone Profile in an Offset Printing Press," which was filed Jun. 10, 1990 in the name of Anton Rodi, one of the inventors herein.

BACKGROUND OF THE INVENTION

1. Field of the Invention

The invention relates to a rotary printing press, and particularly to an offset printing press. The printing unit of the printing press comprises a printing form and includes a damping unit, as well as an inking unit. The inking unit is provided with a set ink profile.

The present invention also relates to an offset printing press having a wetting unit and an inking unit, the inking unit having an ink metering apparatus for the establishment of an ink profile, and wherein the inking unit and the wetting unit each have at least one applicator roller which can be moved into a contact position with a printing forme. As used herein, the terms "printing forme" and "printing form" both refer to an image bearing medium, the image on which is to be printed, e.g., a plate cylinder and/or a printing plate.

2. Background Information

In printing presses of the type mentioned initially, it is generally necessary, for a running-on state, to build up, in the inking unit, an ink profile appropriate for the subject to be printed. If an ink profile suitable for running-on does not yet exist at the start of printing, then, after proofing, a large amount of waste may first be produced before both a desired ink profile and a stable ink/damping-solution equilibrium are obtained. Therefore, in order to prevent or considerably reduce waste, it is highly desirable to have an appropriate ink profile already available at the start of a printing job. This applies, in particular, if a new printing form is being used with a subject different from that of the previous printing job. Furthermore, in order to also prevent waste after a lengthy interruption in printing, such as when an already used printing form is used again, the necessary ink profile should generally be set in the inking unit when proofing takes place.

A printing unit for rotary printing presses that comprises at least two ink-conducting cylinders, such as a plate cylinder and a rubber-blanket cylinder, is known from German Published Patent Application No. 38 00 570. In order to set a state suitable for running-on, a selectively engageable ink-reducing unit is assigned to at least one of the ink-conducting cylinders. The ink-reducing unit assumes the function of the stock, that is, the film of ink and damping solution supplied from the inking unit and from the damping unit is transferred in a manner appropriate to the subject at hand onto the ink-conducting cylinder. The film of ink and damping solution is then accepted by the ink-reducing unit from the ink-conducting cylinder. This makes it possible to set the ink profile necessary for running on without it being necessary to print the stock. Waste can thus largely be prevented.

Furthermore, it is generally known that, when changing printing jobs, such as when using a new printing plate involving a subject different from that of the previous printing form, the inking unit may be cleaned, with the result that the ink profile existing in the inking unit for the previous printing job is eliminated by the removal of ink. However, the removal of an entire volume of ink from the inking unit, which is particularly accomplished by scraping and subsequent washing, is very elaborate and, thus, time-consuming. Furthermore, it is generally necessary, for a new start of printing, to build up an entirely new ink profile within the inking unit. More particularly, it is usually necessary to initially reintroduce a volume of ink generally corresponding to the volume of ink removed.

Generally, on offset printing presses, it is often necessary to have a thin film of ink fed to the printing forme which has been wetted with a wetting agent. For this purpose, there may be provided an inking unit equipped with a number of rollers. The delivery of the wetting agent may be accomplished by means of a wetting unit, which also has an arrangement of rollers. Depending upon the image provided on the printing forme, it is desirable to establish an appropriate and corresponding ink distribution in a direction transverse to the direction of travel of the material to be printed through the offset printing press, to achieve a good printing result. Accordingly, the inking unit is preferably provided with an ink metering device which makes possible the zonal setting of an ink profile. The thickness of the ink layer in the individual zones is established as a function of the requirements for the individual zones. The ink is delivered by means of an ink ductor from an ink pan or reservoir. It is up to the printer to make the zonally required adjustment of the ink metering device as a function of the ink requirements of the image in question. This is done when setting up the offset printing press. Additionally, before the actual printing, a so-called "ink admission" (or "ink profile establishment") is conducted, in which the above-mentioned profiled ink film is built up inside the inking unit. In known prior art devices, during the ink profile establishment period, movable applicator rolls may assume a position where they are separated by some distance from the printing forme, so that there is not yet any inking of the image. The printing forme preferably consists of a plate cylinder, on the convex surface of which a printing plate bearing an image is mounted.

In addition to the ink distribution in the circumferential direction, the ink is also distributed laterally, to some degree, during the ink admission (or ink profile establishment), preferably, by laterally reciprocating (or oscillating) distribution rollers. Consequently, the ink remains pliant (or flexible) and is also uniformly distributed laterally. Undesirable accumulations of ink can also be avoided. However, the lateral distribution (or spreading by rubbing) during the ink profile establishment may, for example, lead to a situation where the ink profile constructed by the ink metering device is evened out to a certain extent once again, so that, in the start-up phase of the subsequent printing process, the lateral ink profile may not be available to the desired extent. Moreover, initially the ink distribution does not satisfactorily correspond to the image, which leads to the generation of waste sheets. Only when the appropriate printing run conditions are achieved, i.e., when an ink profile which properly corresponds to the image has been established, are good printing results achieved.

The problems described above also exist when a so-called "jam" occurs, i.e., a short interruption of the printing process, and also during a pause in the printing run to wash the blanket cylinder of the offset printing press, since, when the printing process is restarted, there will initially be a somewhat unsatisfactory ink profile.

German Published Patent Application No. 37 06 695 discloses a process for the generation of a defined ink distribution in the inking unit of rotary printing machines which is close to the ink profile required for the printing run, and in which, before the beginning of printing, first the ink profile present in the inking unit from the preceding printing job is removed, while the unit is rotating, by closing the ink metering elements and by the return feed into the ink reservoir of the amounts of ink present in the inking unit as a function of the profile, so that a basically constant thickness ink layer remains, the thickness of which is independent of the profile. Then the ink profile required for the subsequent printing job is generated in the inking unit by a zonal adjustment of the ink metering elements with a defined number of revolutions of the inking unit rollers.

Published German Patent Application No. 33 38 143 discloses a presetting of the inking unit. To generate a defined distribution of the ink in the inking unit which is close to that required for the printing run, a precisely measured quantity of ink is transported to the inking unit rollers before the beginning of printing by means of the vibrator rollers, so that a pre-determined distribution of ink layer thicknesses is established upon the rollers of the inking unit.

Published German Patent Application No. 15 61 100 discloses an inking unit for rotary printing presses which has controllable lifting means, to separate defined groups of rollers. These lifting means also move the applicator rollers which interact with the printing forme. When there is an interruption of the printing, the lifting means bring about a separation of certain groups of rollers, and also shut off the applicator rollers.

OBJECT OF THE INVENTION

One object of the present invention is to provide a rotary printing press of the type mentioned above initially, in which it is possible to change the ink profile, in a simple manner and at short notice, with the result that there may be a reduction of the set-up times when there is a change of printing job. Furthermore, it is generally desired that the state suitable for running-on may be achieved as quickly as possible when proofing, so that waste may largely be prevented.

Another object of the present invention is the provision of an offset printing press in which an ink distribution close to that required for the printing run can be established very quickly, so that waste can be eliminated as much as possible.

SUMMARY OF THE INVENTION

The objects of the invention are achieved in that, in order to eliminate the previous ink profile and to prepare the buildup of a new ink profile, the printing form is preferably inked over substantially its entire surface area with the inking unit. As a result, the previously existing ink profile may be substantially destroyed or equalized. As a result of the inking of the printing form over its entire surface area, there will usually be a corresponding ink distribution into the printing unit, meaning that there will also generally be an equalized ink distribution over the longitudinal extent of the inking unit rollers. This distribution tends to create a good basis for building up the new ink profile needed for the subsequent printing job on what may be termed the "base ink-film thickness" thus formed. This would then tend to dispense with the need to remove the entire volume of ink from the inking unit, with the result that there may be a considerable reduction of the set-up times when there is a change of printing job. Moreover, the new ink profile may be built up considerably faster on an equalized base ink film than may be possible in an inking unit that has been washed and that is ink-free. With the inking of the printing form over its entire surface area according to the invention, the ink-profile presetting of the metering elements in the region of the ink duct of the inking unit can either maintain the old presetting or the printer may already make a new presetting there. Preferably, however, it is also alternatively possible to enact a neutral setting of the metering elements in the region of the ink duct of the inking unit. If the ink-profile presetting appropriate for the new printing job is already performed when the printing plate is inked, it then may be possible to achieve the subject-dependent ink profile suitable for running-on even sooner, with the result that waste may largely be prevented.

It should be appreciated that adjustment mechanisms for ink metering elements are generally well known in the art of offset rotary printing. A "neutral setting" of the ink metering elements, mentioned above, is generally indicative of a state in which the metering elements allow substantially no ink to be transferred from the ink duct to the rollers of the inking unit. Therefore, in the context of the present invention, a neutral setting of the ink metering elements would tend to imply that the inking of the printing form over its entire surface area according to the invention is, generally, accomplished by transferring ink only from the inking unit rollers to the printing plate. As a result, because there tends not to be any ink entering the inking unit from the ink duct when there is a "neutral setting" of the ink matering elements, the quantity of ink among the ink rollers of the inking unit tends to decrease, thereby substantially resulting in an ink film of reduced thickness on the ink rollers, which ink film, usually, is substantially evenly distributed over the surface area of the ink rollers. Adjustment mechanisms for ink metering elements are described in U.S. Pat. No. 5,010,820 to Löffler, entitled "Process for the Production of an Ink Distribution Appropriate to a Production Run in the Inking Unit of Rotary Printing Presses". The "neutral setting" discussed above is generally referred to in this U.S. Patent as an "equilibrium ink zone setting".

Preferably, in order to ink the printing form over its entire surface area, the damping unit is controlled in such a manner that no damping solution or only a reduced quantity of damping solution is supplied to the printing form. The absence of damping solution, or the presence of an insufficient amount thereof, generally implies that, in this context as well as during running-on, normally ink-free regions of the printing form accept or absorb ink. Consequently, the full-surface-area inking according to the invention may then result.

The supply of damping solution can be suppressed in that the damping-solution applicator roller or damping-solution applicator rollers of the damping unit may assume a disengaged position with respect to the printing form during the inking of the printing form. If the damping unit and inking unit are interconnectable by an intermediate roller disposed between the two units, then the intermediate roller should preferably be brought into a disengaged position with respect to the damping unit and/or the inking unit, so that no damping solution is able to pass via the intermediate roller to the inking unit and thence to the printing form.

In order for the printing form, inked over its entire surface area, to be freed again from the ink, a rubber-blanket washing apparatus, assigned to a rubber-blanket cylinder, may be provided. The rubber-blanket washing apparatus may wash the printing form if the rubber-blanket cylinder assumes an engaged position with respect to the printing form. Thus, in such a configuration, the rubber-blanket washing apparatus not only washes the rubber blanket, but, as a result of the engaged position of the rubber-blanket cylinder with respect to the printing form, that is, with respect to the printing plate clamped onto a plate cylinder, the washing liquid may also be supplied to the printing plate. In the event that the design of the printing press does not allow an exclusively engaged position between the rubber-blanket cylinder and plate cylinder, and that a backpressure cylinder conducting the stock, such as paper, will potentially come close enough to the rubber-blanket cylinder to warrant fears of the transfer of washing liquid, then a paper-thickness compensator, generally provided in actual fact for paper-thickness compensation, may be adjusted in such a manner that there is a sufficient distance between the backpressure cylinder and rubber-blanket cylinder to prevent the transfer of washing liquid.

In order to ensure that the equalized ink profile built up in the inking unit is not destroyed by the washing liquid, a separation should generally be effected, during washing, between the printing form and the inking unit. The inking unit preferably comprises at least one inking roller cooperating with the printing form. Therefore, during washing, the inking roller or rollers should usually be moved into a disengaged position with respect to the printing form.

The invention further relates to a process for the building up of a new ink profile in an inking unit of a rotary printing press comprising a printing form, particularly an offset printing press, preferably for the execution of a new printing job, in which, in order to destroy or equalize the previous ink profile, the printing form is preferably inked over its entire surface area by means of the inking unit. After the previous ink profile has been destroyed or equalized, the printing form may be washed. This washing operation may take place in the printing press. However, it may be necessary in this case for the inking unit to assume a disengaged position with respect to the printing form, so that no washing liquid is transferred. Particularly, the washing operation is preferably performed with a rubber-blanket washing apparatus. For this purpose, the rubber blanket preferably assumes an engaged position with respect to the printing form, which printing form is preferably in the form of a printing plate, such as an aluminum plate, clamped onto a plate cylinder.

Other objects are achieved by means of the present invention, in that, for the generation of an ink profile close to that required for the printing run, the applicator rollers are continuously or temporarily moved, during the admission of the ink and before the beginning of printing, or during a jam or blanket washing process interrupting one of the printing processes, by a control apparatus, into a position where they are in contact with the printing forme. Therefore, during at least a portion of the period when the machine is not printing, the rotating application rollers of the inking unit and the wetting unit do not assume the position of the prior art, where they are separated from the rotating printing forme, but, according to the invention, they remain, for a determinate period of time, in a contacting position. Consequently, the image of the printing plate supports the ink distribution such that an ink profile which largely corresponds to the image is established. Simultaneously, the zonal ink profile established in the ink metering apparatus, but which has been evened out to a certain extent by the smoothing action of the rollers, is reestablished by the invention, in particular on the applicator rollers, by means of alternate or reverse action with the printing plate, so that, when the printing resumes and immediately thereafter, a zonal ink feed can be established which meets the profile requirements. Preferably, and in accordance with an embodiment of the invention, not only the applicator rollers of the inking unit, but also the applicator rollers of the wetting unit assume a position where they are in contact with the printing forme, to produce the desired reverse action process, and also to prevent a coloration of sections of the image which are normally free of ink.

In one preferred embodiment of the invention, during the admission of the ink, during a jam or during a blanket washing process, the control apparatus reduces the quantity of wetting or damping agent delivered, compared to the quantity delivered during the printing run. In this manner, an excess of wetting agent on the printing plate is prevented. Preferably, the feed of wetting agent is set at a value which makes up for any losses which occur (e.g. by evaporation), so that an equilibrium is achieved.

The proper metering of wetting agent adjusted to the current operating conditions is performed by the control apparatus, by adjusting the number of revolutions and/or speed of rotation of a wetting fountain roller. A portion of the circumference of the wetting fountain roller is in contact with the wetting agent, and transfers the amount of wetting agent transported by it to a downstream metering roller of the wetting unit. In addition to the adjustment of the amount of wetting agent transported through adjustment of the number of rotations and/or speed of the fountain roller, an influence can also be exerted by means of the pressure between the fountain roller and the metering roller, and by an inclination of the above-mentioned rollers in relation to one another.

In another preferred embodiment of the invention, simultaneous with or subsequent to the inking of the printing forme produced by the contact between the applicator rollers and the printing forme, the blanket of a blanket cylinder of the offset printing machine is also inked. In addition to the inking of the printing forme by the contact between the applicator rollers of the inking unit and wetting unit, a feature is created here which assists the rapid achievement of proper conditions for the print run. As a result of the interaction between the blanket and the printing forme, a positive influence is also exerted on the ink distribution, so that the generation of an ink distribution which is close to the ink distribution profile required for the printing run is quickly accomplished.

Preferably, in this embodiment of the invention, the inking of the blanket is achieved by the assumption of a contact position between the inked printing forme and the blanket of the blanket cylinder. The blanket and the printing forme are thereby in positions where they are in contact with one another, but the printing operation of the offset printing press is not yet resumed, because the inking of the blanket takes place before the beginning of the actual printing.

To prevent the printing cylinder of the offset printing press from becoming soiled with the ink/water emulsion during the inking of the blanket, the printing cylinder may assume a position in which it is separated from the blanket or blanket cylinder. In one embodiment of the invention, the blanket cylinder and the plate cylinder are separated from one another during the inking of the printing forme, while, in another embodiment of the invention, the blanket cylinder and the plate cylinder are in contact with one another for a portion of the period of time during which the printing forme is being inked. It is thereby possible, with the use of modern, commercially available printing machines, for the purpose of inking the blanket, to change the printing machine into its printing operation position, but without beginning the printing operation, whereby (in contrast to the normal printing operation position) a printer feed adjustment acting between the blanket cylinder and the printing cylinder is moved out of its current working range in the printing run position, so that the blanket of the blanket cylinder and the printing cylinder assume positions in which they are separated. Therefore, the printer feed adjustment, which has previously been used to compensate for different paper thicknesses, is given a new application in the invention, in that, in addition to its normal range of operation, it effects a relative movement between the blanket cylinder and the printing cylinder, so that the inked blanket does not come into contact with the printing cylinder.

Additionally or alternatively, however, it is also possible, in addition to the print feed adjustment used for the paper thickness compensation, to have an additional device which brings about the separation between the blanket cylinder and the printing cylinder. However, the inclusion of such an additional device then requires additional design measures. In other words, the machines of the prior art must be equipped with a corresponding device.

The above-described method for the generation of an ink distribution which is very close to that required for the printing run is based on the fact that, simultaneous with or subsequent to the inking of the printing forme, when the applicator rollers and printing forme are in the contacting position, an inking of the blanket takes place by the assumption of a contact position between the printing forme and the blanket of a blanket cylinder, whereby in particular, by means of a print feed adjustment, the printing cylinder of the offset printing machine is moved into a position where it is separated from the blanket cylinder. In particular, the separation of the blanket cylinder and printing cylinder is maintained during several revolutions of the blanket cylinder. The blanket is then inked for a corresponding period of time.

The present invention also relates to a process for the generation, in the inking unit of an offset printing press, of an ink distribution which is very close to that required for the printing run, the printing press having an ink metering apparatus for setting the ink profile, and having applicator rollers of an inking unit and a wetting unit which can be moved into a position where they are in contact with a printing forme, wherein the applicator rollers are moved into a contacting position with the printing forme during the admission of the ink which takes place before the beginning of printing, or during a jam or blanket washing process which interrupts the printing run. During the admission of the ink, during the jam or during the blanket washing process, the quantity of wetting agent which is supplied can be reduced from the quantity supplied during the printing run. The adjustment of the ink metering apparatus is made by the printer as a function of the image and, preferably, remains unchanged as long as the applicator rollers remain in the contacting position. In accordance with one particular embodiment, however, it is also possible for the ink metering apparatus to be automatically adjusted, in coordination with the wetting unit control and the applicator rollers, by means of an ink control apparatus, as a function of the operating conditions, so that optimal conditions are created for the printing run.

The embodiments of the invention are explained in greater detail below and with reference to the accompanying figures.

One aspect of the invention resides broadly in a method for changing an ink zone profile in at least one printing unit of a rotary printing press and for substantially reducing a previous ink zone profile corresponding to a previous printing job on a plurality of inking rollers prior to starting a subsequent printing job; said method further being for changing from the previous ink zone profile corresponding to the previous printing job to the subsequent ink zone profile corresponding to the subsequent printing job; the printing press comprising: a printing plate cylinder for positioning a printing plate; the printing plate having a surface area; an ink reservoir for holding a supply of ink and an inking mechanism for transferring the ink between the ink reservoir and the printing plate during operation of the at least one printing unit; the inking mechanism comprising: a plurality of inking rollers, a plurality of individually adjustable ink zone metering devices, at least one ink fountain roller positioned adjacent the plurality of individually adjustable ink zone metering devices, and at least one ink transfer roller for transferring the ink between the ink fountain roller and at least one of the plurality of inking rollers; the method comprising the steps of: substantially eliminating the previous ink zone profile in the printing unit; and the step of substantially eliminating the previous ink zone profile comprising transferring a quantity of ink from the inking mechanism to the printing plate such that the quantity of ink covers substantially the entire surface area of the printing plate.

BRIEF DESCRIPTION OF THE DRAWINGS

The invention is illustrated with reference to embodiments shown in the drawings, in which.

DESCRIPTION OF THE PREFERRED EMBODIMENTS

Figure 1:
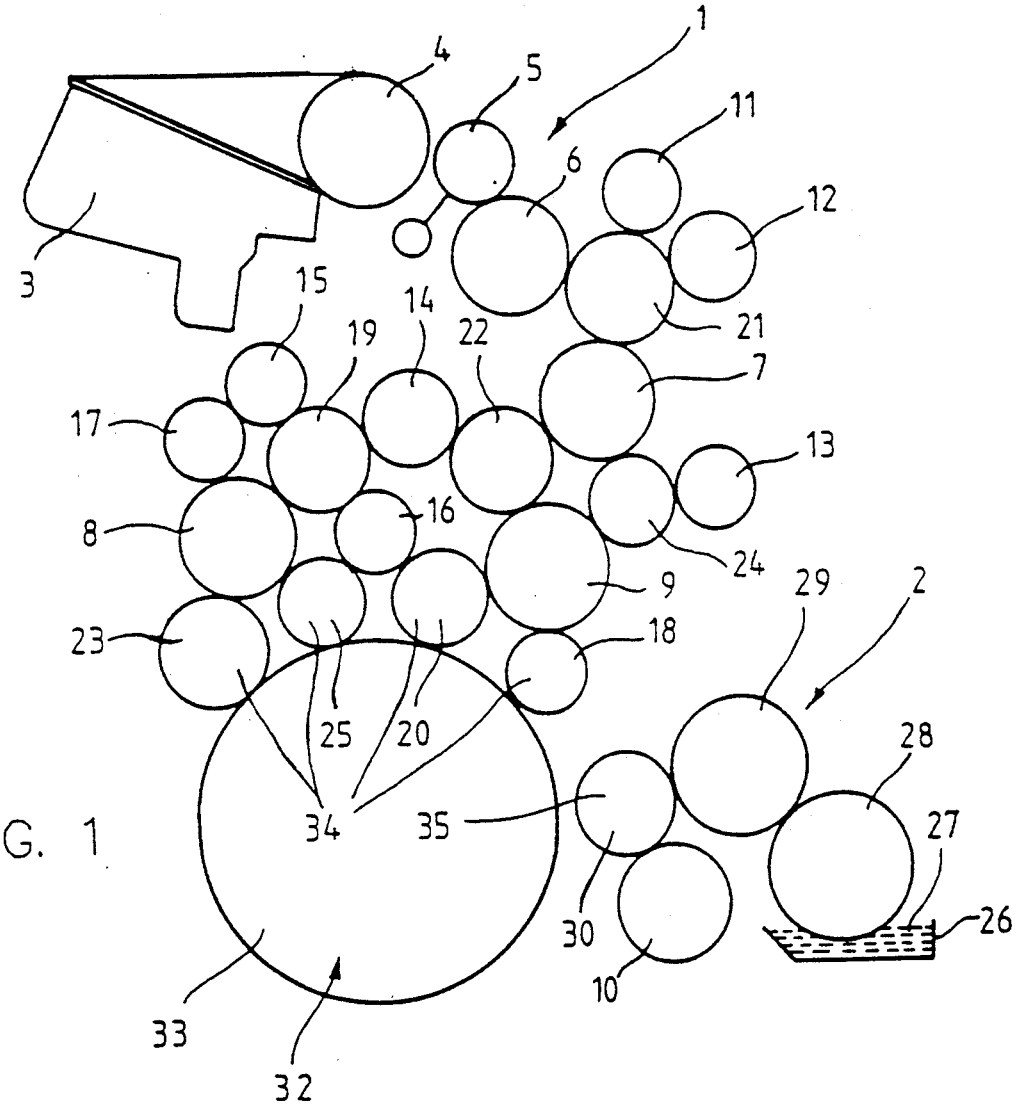
FIG. 1 is a schematic diagram of rollers of an inking unit and damping unit in an offset printing press.

FIG. 1 shows a schematic diagram of rollers in an offset printing press. An inking unit 1 and a damping unit 2 are provided. The inking unit 1 is provided with an ink duct 3, which has metering elements (not shown), and adjustment means 3*a* therefor, for setting zonal inking gaps. An ink-duct roller 4 withdraws ink in a metered manner from the ink duct 3 during operation. A vibrator 5 cooperates with the ink-duct roller 4 as well as with a driven distributor 6. The damping unit 2 comprises a damping-solution box 26 filled with damping solution 27, with a fountain roller 28 being partially immersed in the damping solution 27. The fountain roller 28 cooperates with a metering roller 29. Preferably, a rubber-covered roller 30 is further provided. Preferably, inking unit 1 and damping unit 2 additionally comprise driven distributors 7, 8, 9 and 10. In addition, there are six rider and transfer rollers 11 to 16 and nine rubber-covered rollers 17 to 25 preferably provided. If necessary, inking unit 1 and damping unit 2 may be connected to one another by means of an intermediate roller (not shown).

Both ink and damping solution 27 are supplied to a printing form 32 via the described roller arrangement. The printing form 32 is preferably a printing plate (not shown), wherein the printing plate is clamped onto a plate cylinder 33. The transfer of ink and damping solution 27 from the inking unit 1 and damping unit 2, respectively, to the printing plate is preferably effected by the rubber-covered rollers 18, 20, 23, 25 and 30. Consequently, the rubber-covered rollers may also be referred to as inking rollers 34, and the rubber-covered roller 30, for transferring the damping solution, may be referred to as a damping-solution applicator roller 35.

By means of a control apparatus (not shown), it is possible for the inking rollers 34 and the damping-solution applicator roller 35 to be moved into an engaged or disengaged position with respect to the printing form 32. In the representation shown in FIG. 1, the inking rollers 34 are in their engaged positions and the damping-solution applicator roller 35 in its disengaged position.

Let it be assumed that a printing job, carried out with the printing form or plate 32, clamped onto the plate cylinder 33, has been finished, such that a desired number of copies has been printed. There is now to be a change of printing job; a new printing run is to be performed with a printing plate carrying a different subject.

So that an ink profile appropriate to the running-on state of the new printing process can be set as quickly as possible in the inking unit, the printing form 32, that is, the previously used printing plate clamped on the plate cylinder 33, is, preferably, according to the invention, first inked substantially over its entire surface area. This inking is preferably achieved in that, as a result of the disengaged position of the damping-solution applicator roller 35 with respect to the plate cylinder 33 and in the absence of a connection between damping unit 2 and inking unit 1, substantially no damping solution 27 reaches the printing form 32. It should be understood that, if an intermediate roller were used to interconnect the inking unit 1 and the damping unit 2, the intermediate roller would have to be moved to a separation position. Thus, regions of the printing form 32 that are actually substantially free of ink in the running-on state now accept ink, thus illustrating a phenomenon substantially akin to scumming. It should be appreciated that the inking of the printing form 32 over its entire surface area has repercussions on the ink profile in the inking unit 1. More particularly, in the inking unit 1, the previous ink profile, originating from the printing job performed, is essentially destroyed, by being, in particular, equalized. This leads to a base ink-film thickness, which then advantageously forms the basis for the building-up of a new ink profile for the next printing job. In other words, in inking the printing form 32 over its entire surface area, a substantial quantity of ink tends to be removed from the ink rollers of the inking unit 1, thus essentially resulting in a layer of ink on each of the ink rollers of the inking unit 1 having a reduced thickness and thus resulting in the sought base ink-film thickness.

Figure 2:
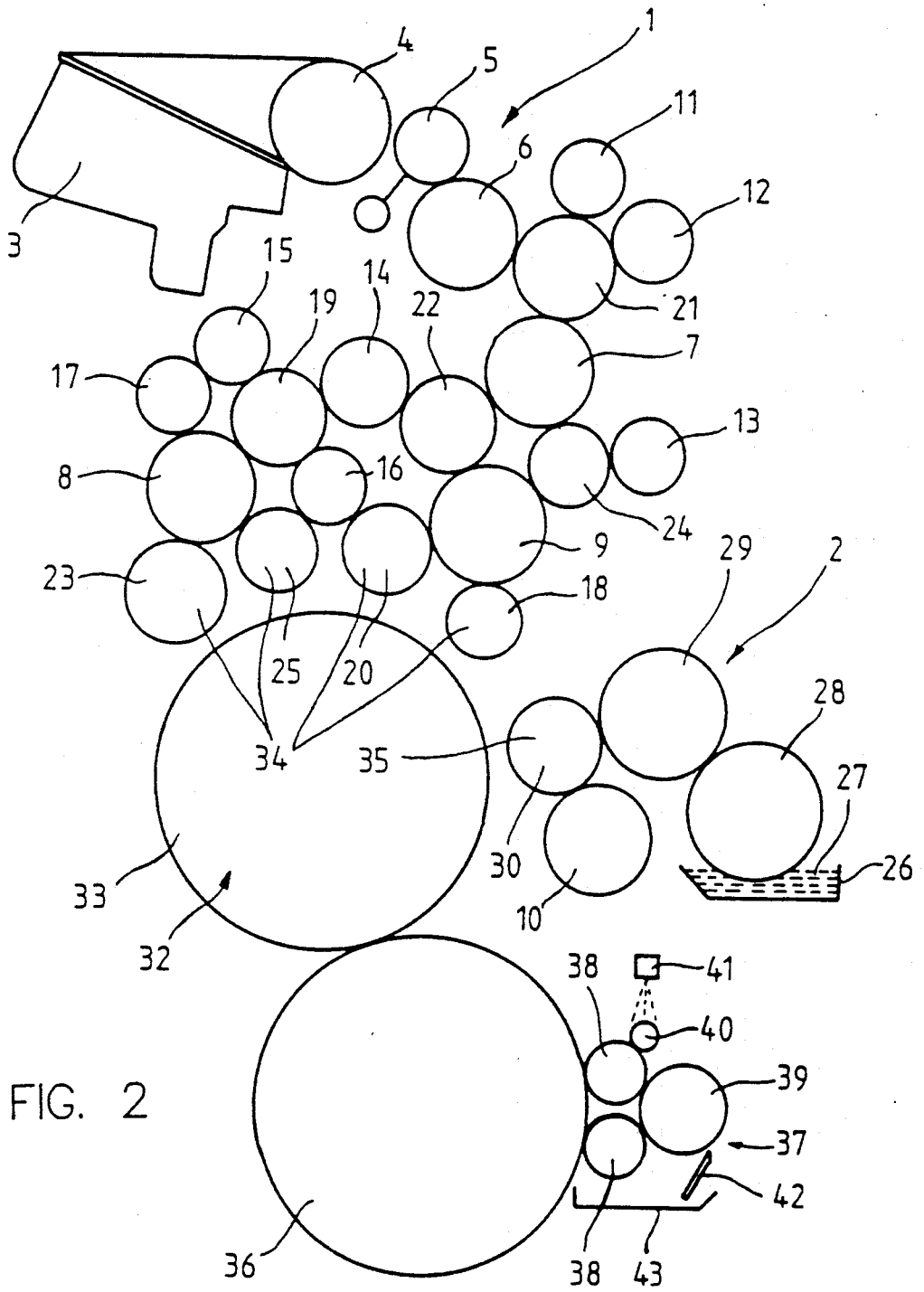
FIG. 2 is the schematic diagram of rollers from FIG. 1, with a rubber-blanket washing apparatus disposed on a rubber-blanket cylinder.

Preferably, before a new printing plate is clamped onto the plate cylinder 33, the old printing plate, inked over its entire surface area, may first be cleaned. For this purpose, as shown in FIG. 2, the inking rollers 34 are preferably moved into disengaged positions with respect to the printing form 32. The damping-solution applicator roller 35 preferably remains in its disengaged position with respect to the plate cylinder 33. A rubber-blanket cylinder 36, usually found in an offset printing press, is preferably brought into an engaged position with respect to the plate cylinder 33. A rubber-blanket washing apparatus 37 is preferably provided for the rubber-blanket cylinder 36 and is preferably disposed adjacent thereto. The washing apparatus 37 may comprise two washing rollers 38, rotatably and contactingly disposed adjacent the outer cylindrical surface of the rubber-blanket cylinder 36, as well as a common roller 39 connecting the washing rollers 38. A transfer roller 40 may also be provided, preferably in contact with the upper washing roller 38 and to which washing liquid can be supplied by means of a spray apparatus 41. Preferably assigned to the roller 39 is a doctor-blade apparatus 42, under which is disposed a collection trough 43.

In a washing position, as shown in FIG. 2, the washing liquid supplied from the spray apparatus 41 may be transferred to the rubber blanket of the rubber-blanket cylinder 36 by means of the transfer roller 40 and the washing rollers 38. The rubber-blanket cylinder 36 may, in turn, transfer a certain proportion of the washing liquid to the plate cylinder 33, and, therefore, onto the printing form 32. As a result, the coating of ink serving as the full-surface-area inking on the printing form 32 may be loosened and carried away. Ink residues and other residues are then generally passed as far as the roller 39, where the residues may be skimmed off by the doctor-blade apparatus 42.

When the previously used printing plate has been cleaned, it may be removed from the offset printing press. The printing plate to be used for the new printing job can then be clamped onto the plate cylinder 33.

In order to equalize the previous ink profile in the inking unit as well as to build up the new ink profile required for the new printing job, it is possible, at the metering elements of the ink duct 3, to already set the zonal inking gaps to the new setting while the printing form 32 is being inked over its entire surface area. Again, the new setting is preferably appropriate for the subject of the new printing plate to be used for the next printing job.

Further, as a variation on the previous versions, it is also possible, first of all, for the old printing plate to be removed and then for the new printing plate to be clamped onto the plate cylinder 33. The new printing plate may then be inked over its entire surface area with a suitable setting of the ink profile. Subsequently, as shown, the printing plate may then be washed. Finally, the actual printing process may be commenced. It should be appreciated that this full-surface inking of the new printing plate would tend to provide the same general results as those discussed above in relation to the inking of the old printing plate. In other words, in this variation involving the new printing plate, a substantial quantity of ink tends to be removed from the ink rollers of the inking unit 1, thus essentially resulting in a layer of ink on each of the ink rollers of the inking unit 1 having a reduced thickness and thus resulting in the sought base ink-film thickness.

It is, however, also possible for the new printing plate, inked over its entire surface area, to "run clean" through the supply of damping solution, that is, the full-surface-area inking may be removed by the supply of damping solution to the ink-free regions. It may then not be necessary for there to be any washing operation such as that mentioned above. As an alternative to the cleaning of the printing form by means of the rubber-blanket washing apparatus 37, it is also possible to use a plate cylinder washing apparatus, which may have components similar to those of the rubber-blanket washing apparatus 37 and which may be disposed adjacent the plate cylinder.

Figure 3:
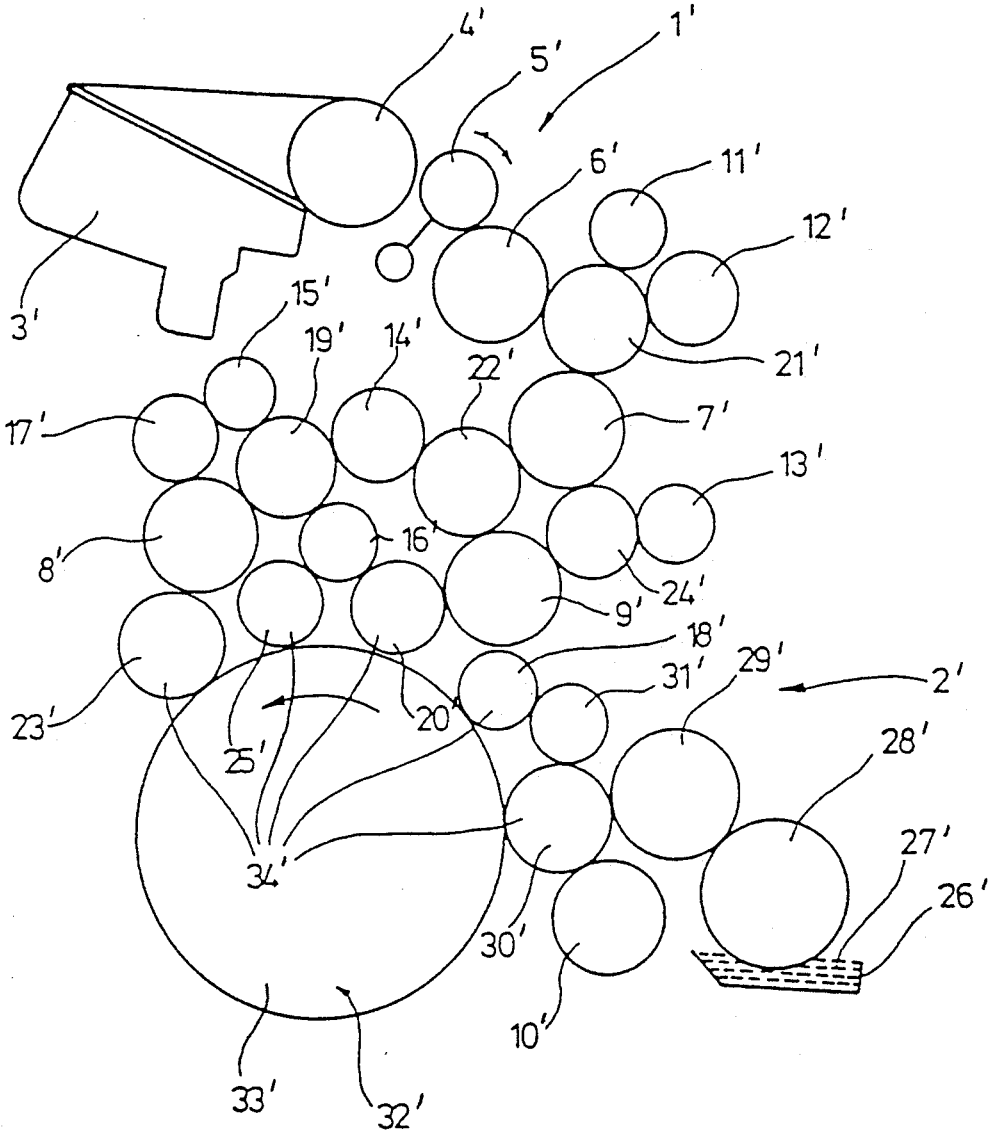
FIG. 3 is a schematic diagram of the rollers of an offset printing press, with the applicable rollers of an inking unit and a wetting unit moved into a position where they are in contact with a printing cylinder.

FIG. 3 is a schematic illustration of an offset printing press having an inking unit 1' and a wetting unit 2' The inking unit 1' has an ink pan or ("ink reservoir") 3' with an ink metering device, from which an ink ductor extracts measured amounts of ink during operation. A fountain roller 5' interacts with an ink ductor roller 4' and with a driven distributing cylinder 6,. The inking unit and the wetting unit 1' and 2' also have additional, preferably driven, distributing cylinders 7', 8', 9', 10'. There are also six riding rollers and transfer rollers 11' to 16' and two rubber rollers 17' and 18'. The inking unit 1' also has two rubber rollers 19' and 20', and three additional, larger-diameter rubber rollers 21' to 23'. There are also two rubber rollers 24' and 25' which have diameters which are smaller than those of the rubber rollers 19' and 20'.

The wetting unit 1' has a reservoir 26', which is filled with a wetting agent, and in which a portion of the circumference of a wetting fountain roller 28' is immersed. The wetting fountain roller 28' interacts with a wetting agent metering roller 29'. There is also provided a rubber roller 30 and an intermediate roller 31'.

By means of the arrangement of rollers described above, both ink and the wetting agent are transported to a printing forme 32'. The printing forme 32' is configured as a plate cylinder 33', on the circumference of which there is clamped a printing plate having an image thereon, well known in the art and therefore not described in any further detail.

Figure 4:
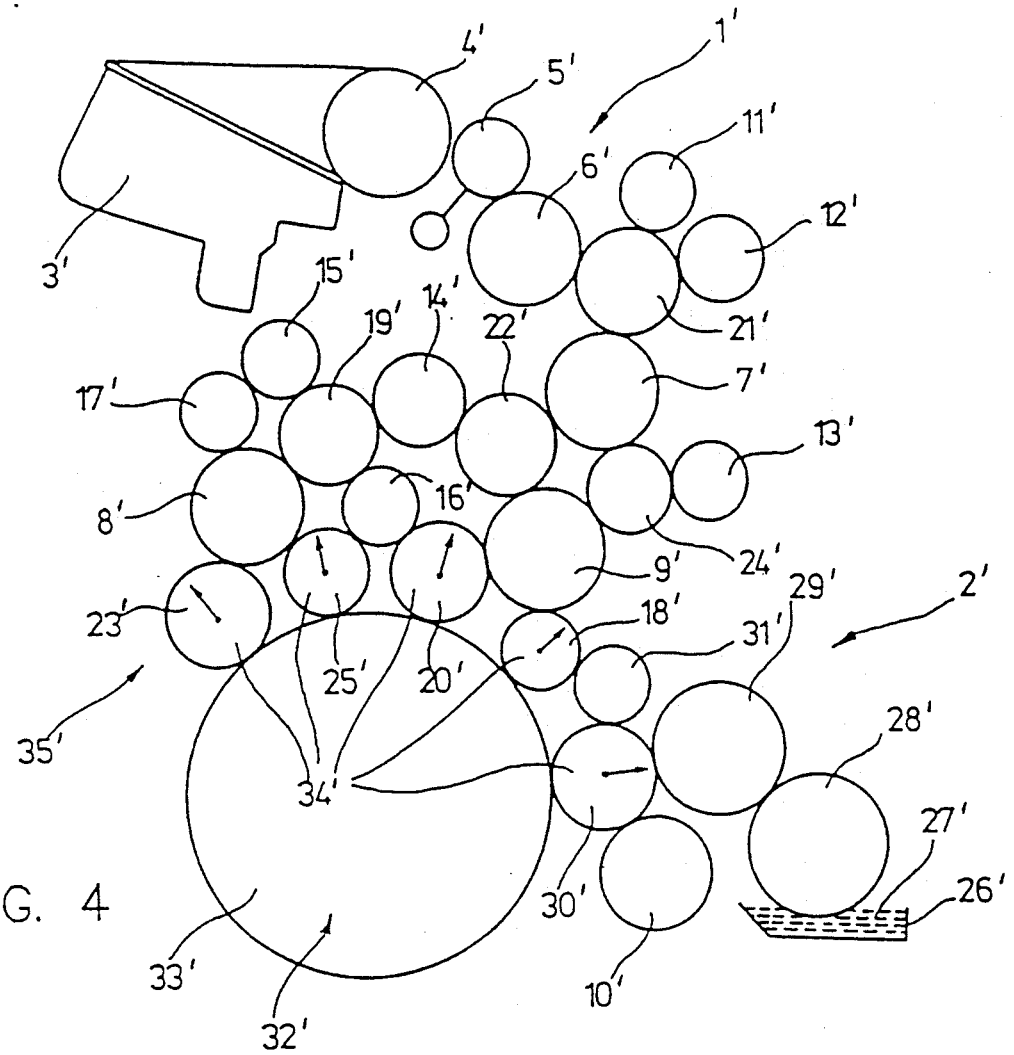
FIG. 4 is a schematic diagram, similar to the arrangement illustrated in FIG. 3, indicating however one possibility for moving the applicator rollers into noncontacting positions.

As shown in FIGS. 3 and 4, the transfer of ink and wetting agent to the printing plate (or printing forme 32') from the inking unit 1' and the wetting unit 2', respectively, is accomplished by the rubber rollers 18', 20', 23', 25, and 30', which are, therefore, also designated as applicator rollers 34'.

The offset printing press is further provided with a control apparatus 35' (shown more fully in FIG. 5), which makes possible the movement of the applicator rollers 34' towards and away from the printing forme 32'.

Figure 5:
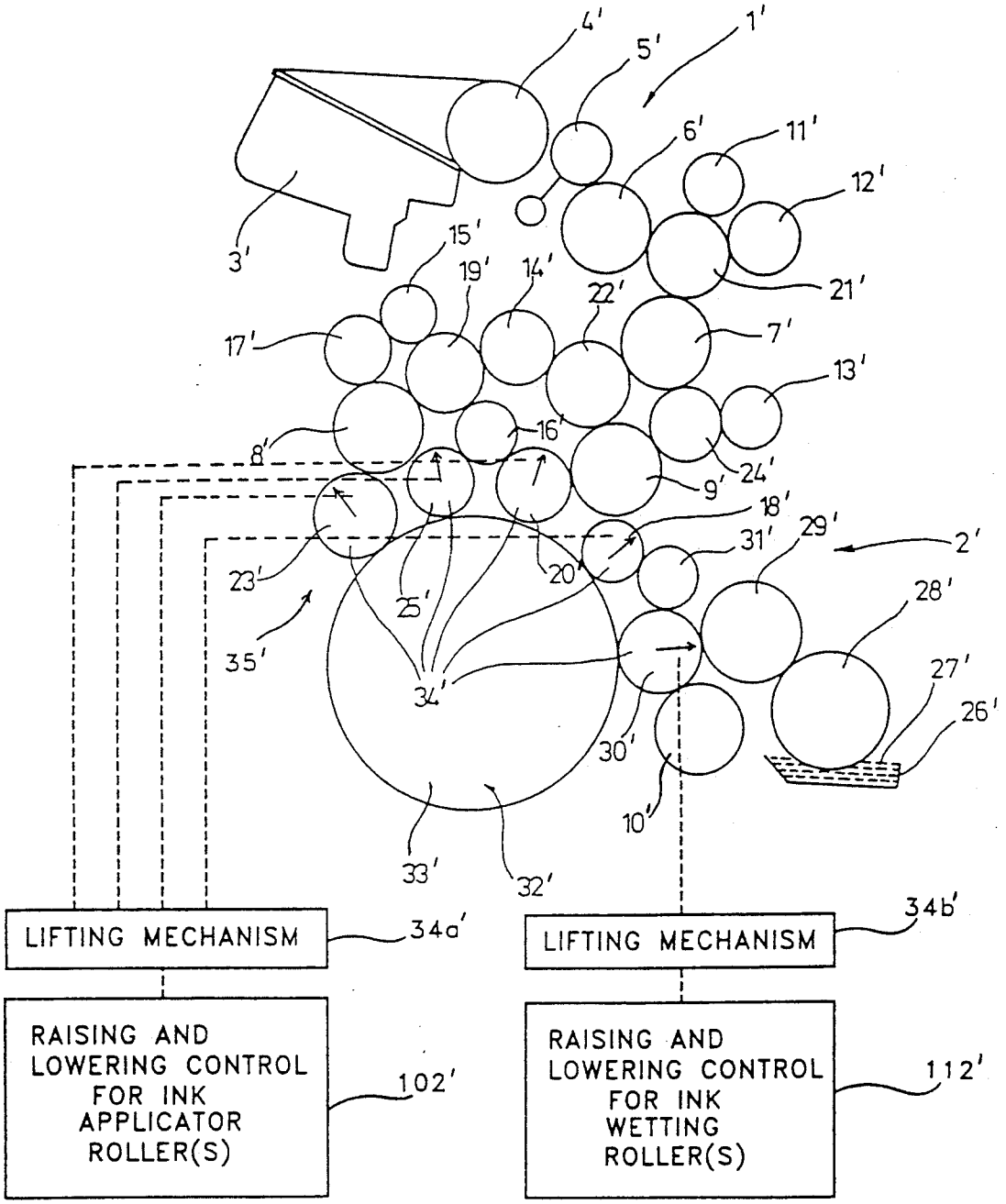
FIG. 5 is a schematic diagram, similar to FIG. 4, with a lifting mechanism shown.

In FIG. 5, lifting mechanisms **34*a*' and 34*b*' are shown which lift the rollers 18', 20', 25', 23', and the roller 30', respectively. Raising and lowering controls 102' and 112' control the operation of the lifting mechanisms 34*a*' and 34*b*'**, respectively, according to the various embodiments of the invention described herein.

Mechanisms which can effect, selectively, a relative separation or a relative contacting between a pair of rollers or a set of rollers are well known in the art and are therefore not described in detail herein. For example, Published German Patent Application No. 15 61 100, discussed above, discloses an inking unit for rotary printing presses having a controllable lifting mechanism for separating particular groups of rollers. In particular, there is disclosed a mechanism for the separation of a group of ink applicator rollers from a plate cylinder. Moreover, as discussed hereafter, U.S. Pat. No. 3,869,983, issued to Garber and entitled "Variable Repeat-Length Web Press", discloses an apparatus for moving one roller toward and away from a second roller.

Figure 6:
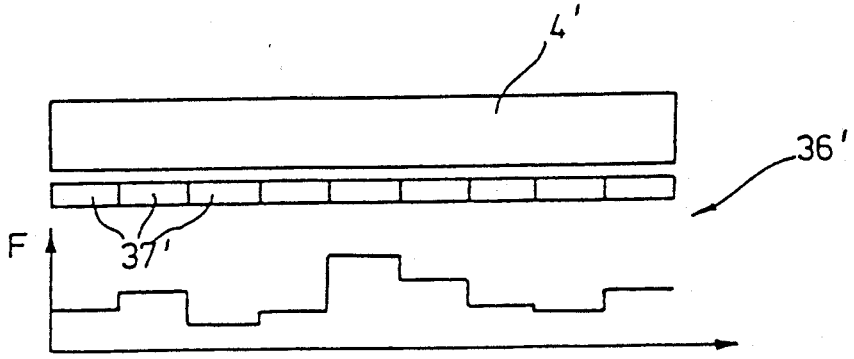
FIG. 6 is a schematic diagram of an ink metering apparatus, as well as a schematic diagram of an ink profile generated thereby.

Adjacent the ink pan 3' there is provided an ink metering apparatus 36', which is schematically illustrated in FIG. 6. The ink metering apparatus 36' makes possible, over the length of the ink ductor 4', a zonal adjustment of the lateral ink profile, e.g., like the one illustrated in the diagram in FIG. 6. In each zone 37', the quantity of ink delivered (e.g., the ink layer thickness F) can be set so that it is appropriate for the inking requirements of the image on the printing plate (or printing forme 32').

By means of the control apparatus 35', the applicator rollers can be moved into the contacting position illustrated in FIG. 3, wherein the applicator rollers 34' of the inking unit 1' and of the wetting unit 2' are in contact with the printing plate (or printing form 32') clamped on the plate cylinder 33'. In FIG. 4, the arrows corresponding to the applicator rollers 34' indicate that a shift can be made by means of the control apparatus 35', so that there is a separation between the applicator rollers 34' and the convex surface of the plate cylinder 33', and therefore, the surface of the printing plate clamped thereon.

According to the invention, before the beginning of printing, and in particular during the admission of the ink or during an interruption of the printing run, in particular during jams and/or blanket washing processes, the applicator rollers 34' remain in the contact position with the plate cylinder 33', as shown in FIG. 3. This generates an ink profile close to that required for the printing run. This has the advantage that when the printing is begun or resumed, the desired ink profile corresponding to the image can be achieved in the shortest possible time, so that optimal, essentially waste-free printing results can be achieved. The contact position can also be assumed by the applicator rollers 34' only temporarily, that is, during only a portion of the admission of the ink or of an interruption in the printing process.

WORKING EXAMPLES

Figure 7:
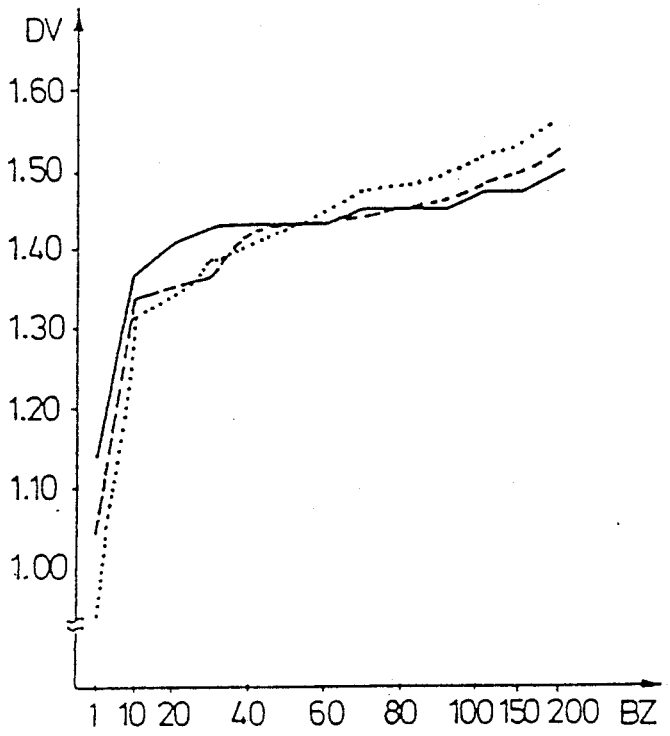
FIG. 7 is a plot illustrating the average full tone density established after the start of printing.
Figure 8:
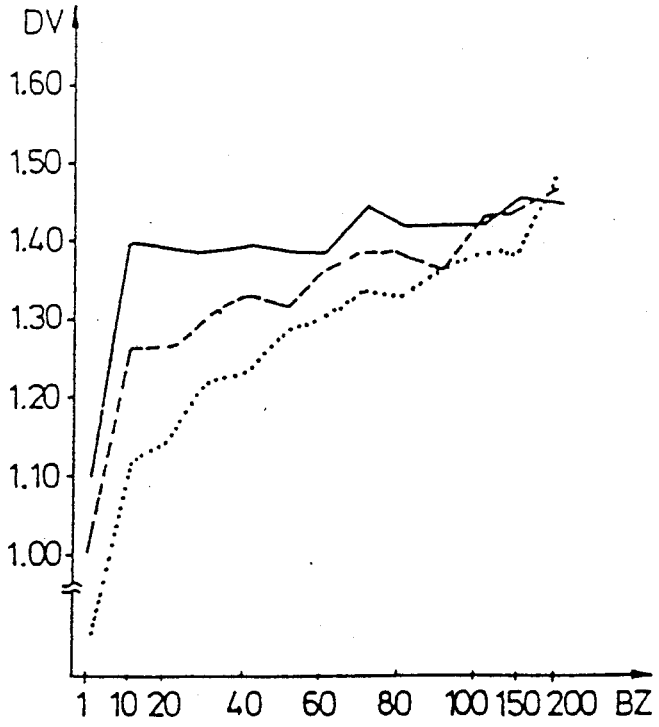
FIG. 8 is a plot, like FIG. 7, showing a zone of the ink metering apparatus with a high ink feed.
Figure 9:
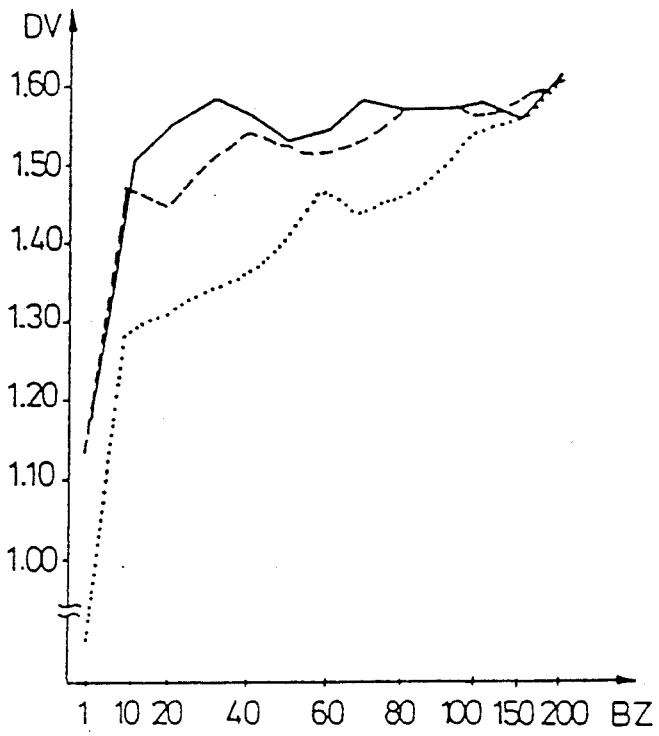
FIG. 9 is a plot, as in FIG. 8, of a zone with a low ink feed.

By way of example, FIGS. 7, 8 and 9 are plots derived from ink admission (or ink profile establishment) tests, in which the full tone density DV is plotted on the ordinate and the number of sheets produced after the beginning of printing (the sheet count: BZ) is plotted on the abscissa. The solid-line curves set forth in FIGS. 7 to 9 show the full tone density DV when the ink profile has been set, and when an ink admission period lasting 6 minutes has been conducted. According to the invention, during the ink admission, the applicator rollers 34' shown in FIG. 3 are in their contacting position to produce the results shown by the solid-line curves. This contact can be continuous, i.e., it can last for the entire duration of the ink admission period, or the contact can be temporary, i.e., lasting only a portion of the ink admission period. Additionally, depending on the current conditions, different periods of contact are also conceivable. The contact position can also be continued for only a determined number of machine revolutions. During this admission time or period of contact, the quantity of wetting agent delivered is increased as follows: beginning: 33.3%, then 55.5%, the final 2 minutes 88.8% and finally (i.e., during the printing run) 100%.

In contrast, the dashed curves set forth in FIGS. 7 to 9, show the full tone density DV produced according to processes of the prior art, i.e., 6 minutes of ink admission and an adjustment of the ink metering apparatus 36' according to the printing run profile. Moreover, according to the processes known in the prior art, and shown by the dashed curves in FIGS. 7 to 9, the applicator rollers 34' are moved into the position where they are in contact with the plate cylinder 33' only at the beginning of printing. Additionally, the amount of wetting agent fed is 100%.

Finally, the dotted curves in FIGS. 7 to 9 also show the full tone density DV according to other known processes of the prior art, that is, an ink admission time of 6 minutes, the ink profile is initially uniform over the entire printing width, and the printing run profile is established only after 6 minutes have passed.

In FIG. 7, the average value of the full tone density DV is shown as measured over all zones 37'. It is apparent that by means of the process according to the invention, the curve quickly approaches a final value after a relatively few sheets, for example 40, while, with the process of the prior art, the final value is reached only after a significantly greater number of sheets. In the range of 100 to 200 sheets, all 3 curves still exhibit an ascending tendency of the full tone density DV, but the curve ascent of the process according to the invention is the smallest of the three.

The diagram in FIG. 8 shows the full tone density DV of a certain zone 37', which, on account of the image, requires a relatively large amount of ink. While, with the processes of the prior art, the full tone density DV increases only slowly after the beginning of printing, with the process according to the invention, it reaches the final value after relatively few impressions.

The diagram in FIG. 9 shows the full tone density DV of a zone 37' which requires only a small amount of ink. Here too, it is apparent that the final value of the full tone density DV corresponding to the printing run status is achieved with the process according to the invention significantly earlier than is the case with the processes of the prior art.

Figure 10:
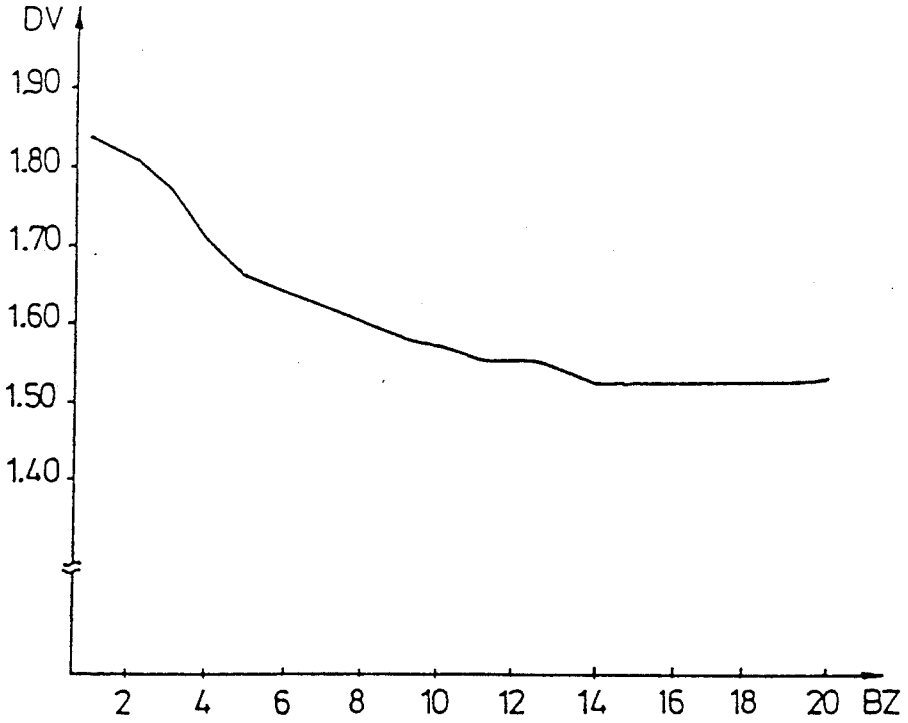
FIG. 10 is a plot of the full tone density following a paper jam.

The diagram in FIG. 10 shows the curve of the full tone density DV as a function of the number of sheets BZ on the occasion of a paper jam, i.e., an interruption of the printing run. During the jam, the rotating applicator rollers 34', in accordance with, the invention, remain in contact with the rotating plate cylinder 33'. The interruption lasts 6 minutes, and during that time, the wetting agent feed is increased from 44.4% to 55.5% and finally to 66.6%. During the start-up phase, it is 66.6%, and finally reaches 100% in the printing run condition. It is apparent that the full tone density DV is quickly approaching the final value required for the printing run process after approximately 14 sheets.

Figure 11:
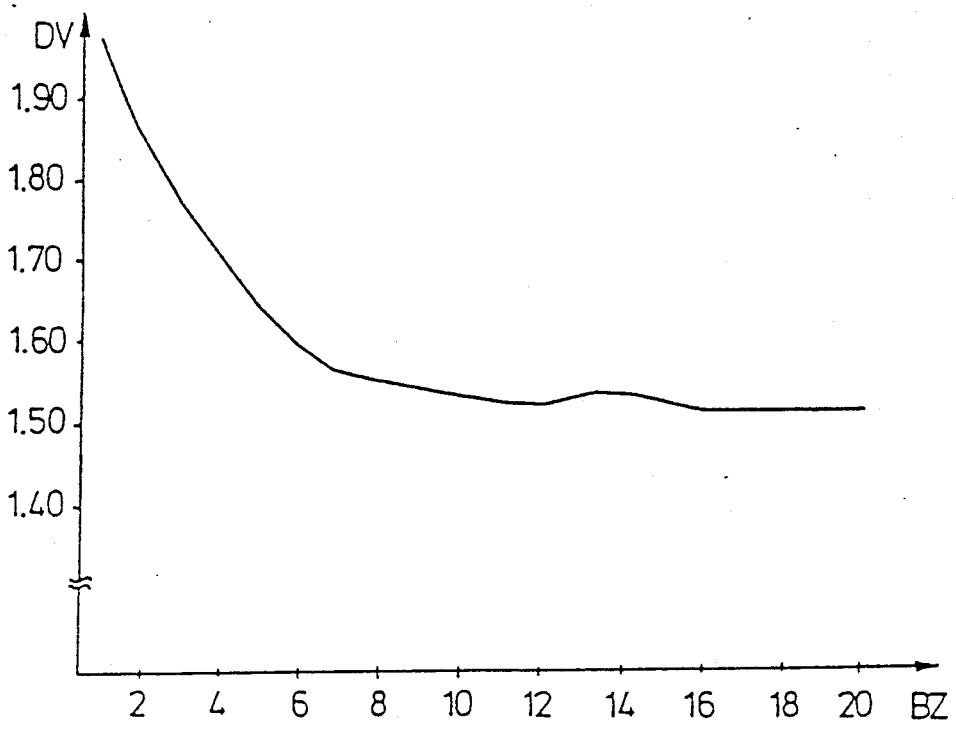
FIG. 11 is a plot, as in FIG. 10, following a stoppage in the feeding of paper to be printed.
Figure 12:
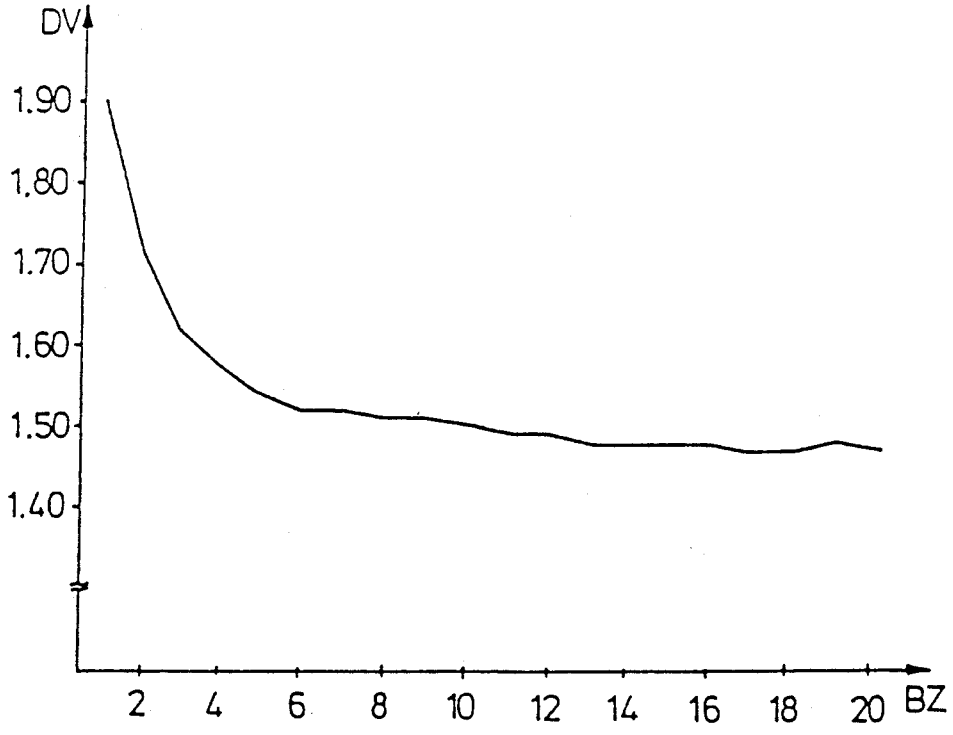
FIG. 12 is a plot, as in FIG. 11, with an excess wetting process.

FIGS. 11 and 12 show the curve of the full tone density DV following a paper feed jam, i.e., an interruption of the printing run. In both cases, during the jam, the applicator rollers 34', in accordance with the invention, remain in contact with the plate cylinder 33'. In the test illustrated in FIG. 11, the start-up occurs after 16 revolutions. This is also true for the test illustrated in FIG. 12, but here, shortly before the start-up, an excess wetting is performed. In both cases, the required full tone density DV is achieved after approximately 15 sheets following the resumption of printing operations.

FIGS. 7–10 illustrate impressively that, by means of an offset printing press method and/or apparatus according to the invention, an ink profile close to that required for the printing run can be achieved in an extremely short period of time, so that as little paper as possible is wasted.

Figure 15:
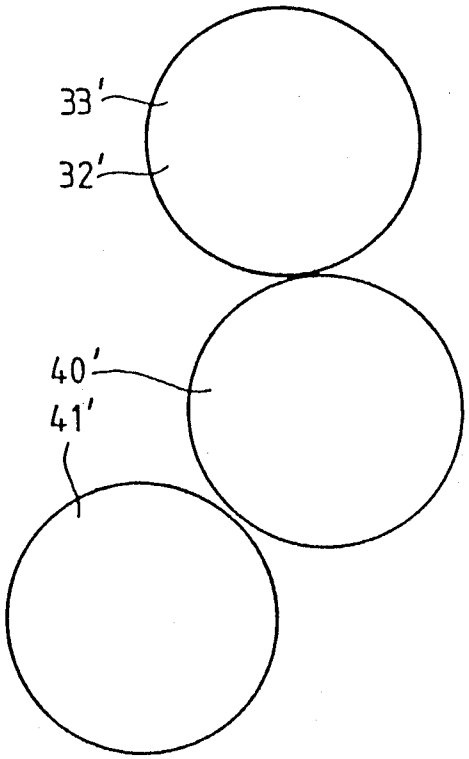
FIG. 15 is a schematic diagram, as in FIG. 14, but with the offset printing press in the printing run position.
Figure 14:
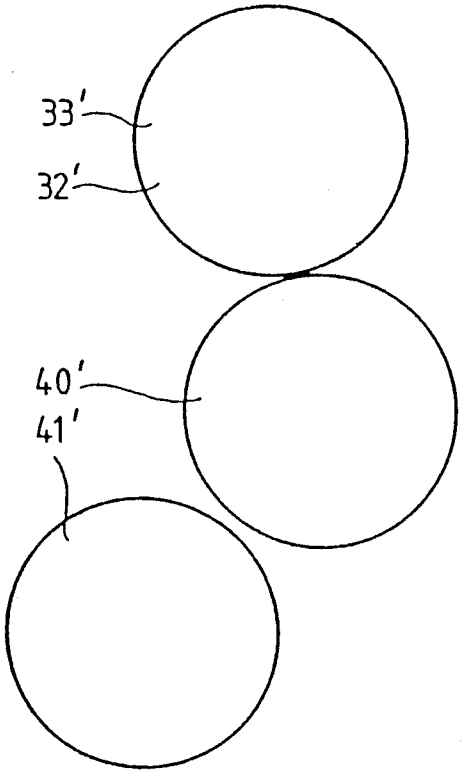
FIG. 14 is a schematic diagram, as in FIG. 13, but during the inking of the blanket.

In addition to the measures described above, simultaneous with or subsequent to the inking of the printing forme 32', the blanket of a blanket cylinder 40' can also be inked. This aspect of the invention is schematically illustrated in FIGS. 13 to 15.

Figure 13:
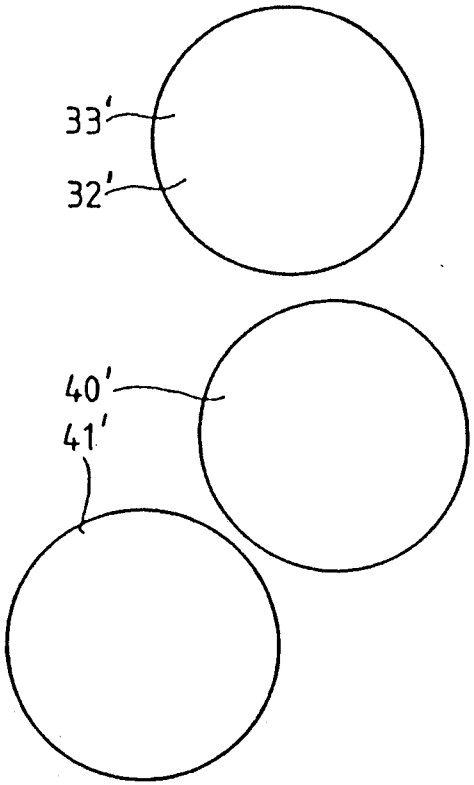
FIG. 13 is a schematic diagram showing the arrangement of a plate cylinder, a blanket cylinder and a printing cylinder, before the inking of a rubber blanket of the blanket cylinder.

FIG. 13 shows the plate cylinder 33', as well as a blanket cylinder 40' and a printing cylinder 41' of an offset printing press. In FIG. 13, these cylinders are shown in their positions before the beginning of printing. The plate cylinder 33' and the blanket cylinder 40' are spaced at some distance from one another. The blanket cylinder 40' and printing cylinder 41' are also spaced at a slight distance from one another. The distance between the blanket cylinder 40' and the printing cylinder 41' is coordinated with the thickness of the material to be printed (e.g. paper). The adjustment to the printing material thickness is done by means of a so-called "print feed adjustment". Print feed adjustment mechanisms, which may also be known as "paper thickness compensators", for adjusting the distance between a blanket cylinder and a printing cylinder are well known in the prior art and are, therefore, not described in detail herein. For example U.S. Pat. No. 3,869,983, issued to Garber and entitled "Variable Repeat-Length Web Press" discloses an apparatus for moving an impression roller toward and away from a printing roller. The print feed adjustment preferably has an electrical adjustment mechanism for the positioning according to the thickness of the material to be printed. To be able to ink the blanket of the blanket cylinder 40' simultaneous with or subsequent to the inking of the printing forme 32', the position in FIG. 14 is assumed. This is a quasi-operating position, but the printing operation is not initiated, and in contrast to the normal printing run position, the blanket cylinder 40' assumes a position in which it is separated from the printing cylinder 41'. However, the printing forme 32' and the blanket cylinder 40' are in contact with one another, so that the inking of the blanket can be carried out. The separation between the blanket cylinder 40' and the printing cylinder 41' is preferably accomplished by means of the above-mentioned print feed adjustment.

As mentioned above, the print feed adjustment is moved by means of the electrical adjustment out of its customary working range for a paper thickness adjustment, so that there is no contact between the blanket cylinder 40' and the printing cylinder 41'. This also represents a new use of the print feed adjustment mechanisms known in the prior art. The inking of the blanket takes place during a few revolutions of the corresponding cylinder. Once this has occurred, the transition to the actual printing position can be made. In other words, the printing run position in FIG. 15 is assumed, wherein the plate cylinder 33' is in contact with the blanket cylinder 40', and where there is a relatively small separation (not readily visible in FIG. 15) corresponding to the paper thickness adjustment between the blanket cylinder 40' and the printing cylinder 41'.

Figure 16:
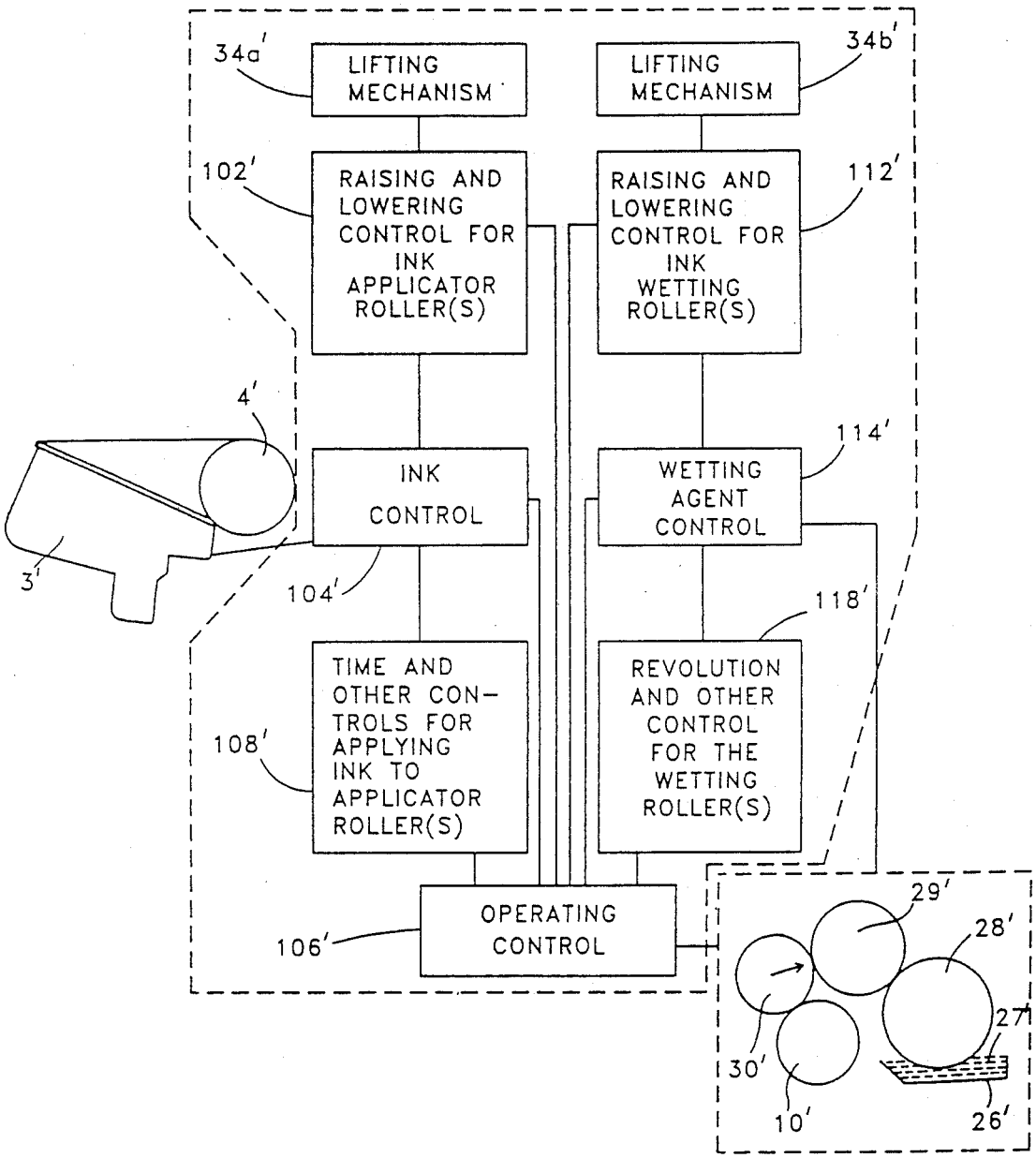
FIG. 16 shows the control system for the printing press.

Now referring to FIG. 16, a control circuit is shown, together with its component control functions and circuitry in block diagram form. Connected to the lifting mechanism **34*a'* is a raising and lowering control 102' for the ink applicator rollers. An ink control 104' is provided which receives signals from the raising and lowering control 102' for the ink applicators and also from an overall operating control 106'. Signals are also provided to the ink control 104' from a control circuitry 108' which controls the times and other controls for applying ink to the applicator rollers. The ink control 104' controls the ink pan 3' and the ink ductor 4'. The lifting mechanism 34*b'* is connected to an analogous raising and lowering control 112' for the wetting rollers. This raising and lowering control 112' for the wetting rollers is connected to the overall operating control 106' and also to a wetting agent control 114'. The wetting agent control 114' controls the distributing cylinder 10', the rubber roller 30', the metering roller 29', and the fountain roller 28', which are part of the printing press. Connected to the wetting agent control 114' is a control circuitry 118' which controls the revolutions and other controls for the wetting agent rollers. Just as the overall operating control 106' is similarly connected to the control circuitry 108', the overall operating control 106' is connected to the control circuitry 118'. The operating control 106'** is also connected to and receives signals from the printing press.

Control systems for controlling various aspects of the operation of an offset printing press, such as, for example, the timings and quantity of various fluid flows, the speed of rotation of various rollers and the timing and degree of separation between specific rollers in such printing presses are well known. For example, the publication entitled "Heidelberg CPC", published by Heidelberger Druckmaschinen AG, D-6900 Heidelberg (Publication No. HN2/43.e) describes such a control system for effecting these various functions and is well known in the art. One aspect of the control system described in this Heidelberg Publication is disclosed in German Published Patent Application No. 37 06 695 discussed above.

Still further, Heidelberg Publication HN1/48.e published by Heidelberger Druckmaschinen AG, D-6900 Heidelberg describes another such control system referred to in the art as the "CPTronic" system, which utilizes fully digitized technology for press control monitoring and diagnoses.

In summary, one feature of the invention resides broadly in a rotary printing press, particularly offset printing press, the printing unit of which comprises a printing form, a damping unit as well as an inking unit, said inking unit being provided with a set ink profile, characterized in that, in order to eliminate the previous ink profile and to prepare the buildup of a new ink profile, the printing form 32 is inked over its entire surface area with the inking unit 1.

Another feature of the invention resides broadly in a rotary printing press characterized in that, in order to ink the printing form 32 over its entire surface area, the damping unit 2 is controlled in such a manner that no damping solution or only a reduced quantity of damping solution is supplied to the printing form 32.

Yet another feature of the invention resides broadly in a rotary printing press characterized in that the damping unit 2 comprises at least one damping-solution applicator roller 35, said damping-solution applicator roller 35 assuming a disengaged position with respect to the printing form 32 during inking.

Still another feature of the invention resides broadly in a rotary printing press characterized by a rubber-blanket washing apparatus 37 assigned to a rubber-blanket cylinder 36, said rubber-blanket washing apparatus 37 washing the printing form 32—said printing form 32 having been inked over its entire surface area—in that the rubber-blanket cylinder 36 assumes an engaged position with respect to the printing form 32.

A further feature of the invention resides broadly in a rotary printing press characterized in that the inking unit 1 comprises at least one inking roller 34, said inking roller 34 cooperating with the printing form 32 and assuming a disengaged position with respect to the printing form 32 during the washing of the latter.

A yet further feature of the invention resides broadly in a process for the building-up of a new ink profile in an inking unit of a rotary printing press comprising a printing form, preferably according to any one or more of the preceding claims, particularly an offset printing press, preferably for the carrying-out of a new printing job, characterized in that, in order to destroy/equalize the previous ink profile, the printing form 32 is inked over its entire surface area with the inking unit 1.

A still further feature of the invention resides broadly in a process characterized in that inking is performed without the supply of damping solution from a damping unit 2.

A yet further feature of the invention resides broadly in a process characterized in that, after the destruction/equalization of the previous ink profile, the printing form 32 is washed.

Still another feature of the invention resides broadly in a process characterized in that washing is performed with a rubber-blanket washing apparatus 37.

A yet further feature of the invention resides broadly process characterized in that a printing form to be used for the new printing job is inked over its entire surface area and is then treated by the supply of damping solution in such a manner that regions of the subject that are ink-free in the running-on state become ink-free.

Examples of components of an offset rotary printing press, which may be utilized with the embodiments of the present invention, may be found in U.S. Pat. No. 5,010,820 to Löffler, entitled "Process for the Production of an Ink Distribution Appropriate to a Production Run in the Inking Unit of Rotary Printing Presses", and which issued on Apr. 30, 1991. This patent corresponds to United Kingdom Patent Application No. 2,202,490, entitled "Setting up Ink Distribution Profiles in Printing Machines", published Sep. 28, 1988. Also, this U.S. Patent corresponds to Federal Republic of Germany Published Patent Application No. 37 06 695, published Sep. 22, 1988.

All of the patents, patent applications and publications recited herein, if any, are hereby incorporated by reference as if set forth in their entirety herein.

The invention as described hereinabove in the context of the preferred embodiments is not to be taken as limited to all of the provided details thereof, since modifications and variations thereof may be made without departing from the spirit and scope of the invention.

What is claimed is:

1. A method for changing an ink zone profile in at least one printing unit of an offset rotary printing press and for substantially reducing a previous ink zone profile corresponding to a previous printing job on a plurality of inking rollers prior to starting a subsequent printing job; said method further being for changing from the previous ink zone profile corresponding to the previous printing job to a subsequent ink zone profile corresponding to the subsequent printing job; the printing press comprising: an ink reservoir for holding a supply of ink and an inking mechanism for transferring the ink between the ink reservoir and the printing plate during operation of the at least one printing unit; a plurality of cylindrical bodies comprising:

a printing plate cylinder for positioning a printing plate, the printing plate for having a printing surface area extending in a substantially circumferential direction with respect to the printing plate cylinder;

a blanket cylinder disposed adjacent the printing plate cylinder and for being engaged therewith;

a plurality of inking rollers for supplying ink to the printing plate cylinder, each of the plurality of inking rollers having an inkable width thereof for the deposition of ink thereupon; and at least one ink transfer roller for supplying ink to the plurality of inking rollers, the at least one ink transfer roller being engaged with the plurality of inking rollers;

the inking mechanism comprising:

the plurality of inking rollers, a plurality of individually adjustable ink zone metering devices, at least one ink fountain roller positioned adjacent the plurality of individually adjustable ink zone metering devices, means for transferring ink away from the ink fountain roller to the plurality of cylindrical bodies, and the at least one ink transfer roller, wherein the at least one ink transfer roller is for transferring the ink between:

the means for transferring ink away from the ink fountain roller and the plurality of inking rollers; and a damping mechanism for providing a supply of damping solution at least to the printing plate cylinder; said method comprising the steps of:

feeding sheets to the at least one printing unit for printing the sheets;

initiating the supply of damping solution to the printing plate cylinder;

mounting the printing plate on the printing plate cylinder;

engaging at least some of the plurality of cylindrical bodies with each other, thereby forming an engaged set of cylindrical bodies, the engaged set of cylindrical bodies comprising at least: the plurality of inking rollers and the printing plate cylinder;

interrupting the feeding of sheets to the at least one printing unit;

subsequent to said step of interrupting the feeding of sheets to the at least one printing unit, substantially eliminating the previous ink zone profile in the printing unit by:

interrupting the supply of damping solution to the printing plate cylinder;

preventing the transfer of ink between the at least one ink fountain roller and the inking mechanism to result in a remnant quantity of ink remaining among the engaged set of cylindrical bodies;

maintaining the engagement of the engaged set of cylindrical bodies;

transferring the remnant quantity of ink solely among the engaged set of cylindrical bodies; and continuing the transfer of the remnant quantity of ink among the engaged set of cylindrical bodies until a layer of ink having a constant thickness is established on both of:

the entire printing surface area of the printing plate; and at least one of the inking rollers throughout the entire inkable width thereof;

removing the printing plate from the printing plate cylinder;

mounting a new printing plate, for the subsequent printing job, on the printing plate cylinder; and subsequent to said step of mounting the new printing plate:

reinitiating the feeding of sheets to the at least one printing unit for printing the sheets;

reinitiating the supply of damping solution to the printing plate cylinder; and reinitiating the transfer of ink between the at least one ink fountain roller and the inking mechanism.

2. A method for changing an ink zone profile in at least one printing unit of an offset rotary printing press and for substantially reducing a previous ink zone profile corresponding to a previous printing job on a plurality of inking rollers prior to starting a subsequent printing job; said method further being for changing from the previous ink zone profile corresponding to the previous printing job to a subsequent ink zone profile corresponding to the subsequent printing job; the printing press comprising: an ink reservoir for holding a supply on ink and an inking mechanism for transferring the ink between the ink reservoir and the printing plate during operation of the at least one printing unit; a plurality of cylindrical bodies comprising:

a printing plate cylinder for positioning a printing plate, the printing plate for having a printing surface area extending in a substantially circumferential direction with respect to the printing plate cylinder;

a blanket cylinder disposed adjacent the printing plate cylinder and for being engaged therewith;

a plurality of inking rollers for supplying ink to the printing plate cylinder, each of the plurality of inking rollers having an inkable width thereof for the deposition of ink thereupon; and at least one ink transfer roller for supplying ink to the plurality of inking rollers, the at least one ink transfer roller being engaged with the plurality of inking rollers;

the inking mechanism comprising:

the plurality of inking rollers, a plurality of individually adjustable ink zone metering devices, at least one ink fountain roller positioned adjacent the plurality of individually adjustable ink zone metering devices, means for transferring ink away from the ink fountain roller to the plurality of cylindrical bodies, and the at least one ink transfer roller, wherein the at least one ink transfer roller is for transferring the ink between:

the means for transferring ink away from the ink fountain roller and the plurality of inking rollers; and a damping mechanism for providing a supply of damping solution at least to the printing plate cylinder; said method comprising the steps of:

feeding sheets to the at least one printing unit for printing the sheets;

initiating the supply of damping solution to the printing plate cylinder;

mounting the printing plate on the printing plate cylinder;

engaging at least some of the plurality of cylindrical bodies with each other, thereby forming an engaged set of cylindrical bodies, the engaged set of cylindrical bodies comprising at least: the plurality of inking rollers and the printing plate cylinder;

interrupting the feeding of sheets to the at least one printing unit;

subsequent to said step of interrupting the feeding of sheets to the at least one printing unit, substantially eliminating the previous ink zone profile in the printing unit by:

interrupting the supply of damping solution to the printing plate cylinder;

preventing the transfer of ink between the at least one ink fountain roller and the inking mechanism to result in a remnant quantity of ink remaining among the engaged set of cylindrical bodies;

maintaining the engagement of the engaged set of cylindrical bodies;

transferring the remnant quantity of ink solely among the engaged set of cylindrical bodies;

continuing the transfer of the remnant quantity of ink among the engaged set of cylindrical bodies until both of:

a layer of ink having a constant thickness is established on at least one of the inking rollers throughout the entire inkable width thereof; and a layer of ink having a constant thickness is established on the entire printing surface area of the printing plate; and subsequent to said step of substantially eliminating the previous ink zone profile in the printing unit:

removing the printing plate form the printing plate cylinder;

mounting a new printing plate, for the subsequent printing job, on the printing plate cylinder; and subsequent to said step of mounting the new printing plate:

reinitiating the feeding of sheets to the at least one printing unit for printing the sheets;

reinitiating the supply of damping solution to the printing plate cylinder; and reinitiating the transfer of ink between the at least one ink fountain roller and the inking mechanism.

3. A method for changing an ink zone profile in at least one printing unit of an offset rotary printing press and for substantially reducing a previous ink zone profile corresponding to a previous printing job on a plurality of inking rollers prior to starting a subsequent printing job; said method further being for changing from the previous ink zone profile corresponding to the previous printing job to a subsequent ink zone profile corresponding to the subsequent printing job; the printing press comprising: an ink reservoir for holding a supply of ink and an inking mechanism for transferring the ink between the ink reservoir and the printing plate during operation of the at least one printing unit; a plurality of cylindrical bodies comprising:

a printing plate cylinder for positioning a printing plate;

a blanket cylinder disposed adjacent the printing plate cylinder and for being engaged therewith;

a plurality of inking rollers for supplying ink to the printing plate cylinder, each of the plurality of inking rollers having an inkable width thereof for the deposition of ink thereupon; and at least one ink transfer roller for supplying ink to the plurality of inking rollers, the at least one ink transfer roller being engaged with the plurality of inking rollers;

a first printing plate, corresponding to the previous printing job, for being mounted on the printing plate cylinder; a second printing plate, corresponding to the subsequent printing job, for being mounted on the printing plate cylinder; each of the first and second printing plates for having a printing surface area extending in a substantially circumferential direction with respect to the printing plate cylinder; the inking mechanism comprising:

the plurality of inking rollers, a plurality of individually adjustable ink zone metering devices, at least one ink fountain roller positioned adjacent the plurality of individually adjustable ink zone metering devices, means for transferring ink away from the ink fountain roller to the plurality of cylindrical bodies, and the at least one ink transfer roller, wherein the at least one ink transfer roller is for transferring the ink between:

the means for transferring ink away from the ink fountain roller and the plurality of inking rollers; and a damping mechanism for providing a supply of damping solution at least to the printing plate cylinder; said method comprising the steps of:

removing the first printing plate from the printing plate cylinder;

mounting the second printing plate on the printing plate cylinder;

prior to said step of removing the first printing plate:

feeding sheets to the at least one printing unit for printing the sheets;

initiating the supply of damping solution to the printing plate cylinder;

mounting the first printing plate on the printing plate cylinder;

engaging at least some of the plurality of cylindrical bodies with each other, thereby forming an engaged set of cylindrical bodies, the engaged set of cylindrical bodies comprising at least: the plurality of inking rollers and the printing plate cylinder;

interrupting the feeding of sheets to the at least one printing unit;

subsequent to said step of mounting the second printing plate:

reinitiating the feeding of sheets to the at least one printing unit for printing the sheets;

reinitiating the supply of damping solution to the printing plate cylinder; and reinitiating the transfer of ink between the at least one ink fountain roller and the inking mechanism;

performing at least one of the following steps (a) and (b):

(a) prior to said step of removing the first printing plate:

subsequent to said step of interrupting the feeding of sheets to the at least one printing unit, substantially eliminating the previous ink zone profile in the printing unit by:

preventing the supply of damping solution to the printing plate cylinder;

preventing the transfer of ink between the at least one ink fountain roller and the inking mechanism to result in a remnant quantity of ink remaining among the engaged set of cylindrical bodies;

maintaining the engagement of the engaged set of cylindrical bodies;

transferring the remnant quantity of ink solely among the engaged set of cylindrical bodies; and continuing the transfer of the remnant quantity of ink among the engaged set of cylindrical bodies until both of:

a layer of ink having a constant thickness is established on at least one of the inking rollers throughout the entire inkable width thereof; and a layer of ink having a constant thickness is established on the entire printing surface area of the first printing plate; and (b) subsequent to said step of mounting the second printing plate:

substantially elminiating the previous ink zone profile in the printing unit by:

preventing the supply of damping solution to the printing plate cylinder;

preventing the transfer of ink between the at least one ink fountain roller and the inking mechanism to result in a remnant quantity of ink remaining among the engaged set of cylindrical bodies;

maintaining the engagement of the engaged set of cylindrical bodies;

transferring the remnant quantity of ink solely among the engaged set of cylindrical bodies; and continuing the transfer of the remnant quantity of ink among the engaged set of cylindrical bodies until both of:

a layer of ink having a constant thickness is established on at least one of the inking rollers throughout the entire inkable width thereof; and a layer of ink having a constant thickness is established on the entire printing surface area of the first printing plate.

4. The method according to claim 3, said method further being for producing the previous ink zone profile, the subsequent printing job being carried out immediately subsequent to the previous printing job, each of the plurality of individually adjustable ink zone metering devices defining a substantially corresponding ink zone of the at least one printing unit, said method comprising the steps of:

prior to said step of removing the first printing plate, producing the previous ink zone profile by initiating operation of:

the printing plate cylinder;

the plurality of inking rollers;

the at least one ink transfer roller; and the at least one ink fountain roller;

by transferring ink from the ink reservoir to the printing plate cylinder via a route of travel which extends:

from the ink reservoir through at least one of the plurality of individually adjustable ink zone metering devices;

thereafter to the at least one ink fountain roller;

thereafter to the at least one ink transfer roller;

thereafter to the plurality of inking rollers; and thereafter to the printing plate cylinder;

printing the previous printing job;

terminating the printing of the previous printing job;

subsequent to said step of mounting the second printing plate, changing to the subsequent ink zone profile corresponding to the subsequent printing job by the process comprising:

initiating operation of at least:

the printing plate cylinder; and the plurality of inking rollers; to transfer ink from the inking mechanism to the printing plate cylinder at least via a route of travel which extends from the plurality of inking rollers to the printing plate cylinder;

producing the subsequent ink zone profile on at least one of the inking rollers; and printing the subsequent printing job.

5. The method according to claim 4, further comprising:

said step of preventing the supply of damping solution to the printing plate cylinder in said step (a) comprising completely preventing the supply of damping solution to the printing plate cylinder; and said step of preventing the supply of damping solution to the printing plate cylinder in said step (b) comprising completely preventing the supply of damping solution to the printing plate cylinder.

6. The method according to claim 5, wherein the damping mechanism comprises a damping solution reservoir and a damping solution applicator roller, the damping solution applicator roller for providing damping solution at least to the printing plate cylinder, the printing press comprising means for selectively positioning the damping solution applicator roller into a first, engaged position against the printing plate cylinder and into a second, disengaged position apart from the printing plate cylinder, said method further comprising:

said step of completely preventing the supply of damping solution to the printing plate in said step (a) comprising the damping solution applicator roller being in the second, disengaged position; and said step of completely preventing the supply of damping solution to the printing plate in said step (b) comprising the damping solution applicator roller being in the second, disengaged position.

7. The method according to claim 6, wherein, said step of performing at least on e of said steps (a) and (b) comprises performing only said step (b).

8. The method according to claim 7, wherein sat least one portion of the printing surface area of the second printing plate is for being free of ink during the printing of the subsequent printing job and at least another portion of the printing surface area of the second printing plate is for retaining ink during the printing of the subsequent printing job, said method further comprising:

applying a quantity of damping solution to the second printing plate subsequent to said step (b) such that the at least one portion for being free of ink during the printing of the subsequent printing job is free of ink.

9. The method according to claim 8, wherein each of said adjustable ink zone metering devices comprises adjustment means for adjusting the adjustable ink zone metering devices, the adjustment means having a neutral setting for causing the ink zone metering devices to prevent the transfer of ink between the at least one ink fountain roller and the at least one ink transfer roller, said method further comprising:

the adjustment means of each of the adjustable ink zone metering devices being in said neutral setting during said step (b) to prevent the transfer of ink between the at least one ink fountain roller and the at least one ink transfer roller.

10. The method according to claim 7, wherein the printing pres further comprises a blanket washing mechanism disposed adjacent the blanket cylinder for transferring washing liquid to the blanket cylinder to wash the blanket cylinder, means for selectively positioning the blanket cylinder at least into a first, engaged position against the printing plate cylinder and into a second, disengaged position apart from the printing plate cylinder, said method further comprising:

washing the second printing plate, subsequent to said step (b), by:

engaging the blanket cylinder with the printing plate cylinder;

transferring washing liquid between the blanket washing mechanism and the blanket cylinder to wash the blanket cylinder; and transferring washing liquid between the blanket cylinder and the printing plate cylinder to wash the second printing plate disposed on the printing plate cylinder.

11. The method according to claim 10, wherein the printing press further comprises means for selectively positioning the plurality of inking rollers at least into a first, engaged position against the printing plate cylinder and into a second, disengaged position apart from the printing plate cylinder, said method further comprising:

disengaging the plurality of inking rollers from the printing plate cylinder prior to said step of washing the second printing plate.

12. The method according to claim 11, wherein each of said adjustable ink zone metering devices comprises adjustment means for adjusting the adjustable ink zone metering devices, the adjustment means having a neutral setting for causing the ink zone metering devices to prevent the transfer of ink between the at least one ink fountain roller and the at least one ink transfer roller, said method further comprising:

the adjustment means of each of the adjustable ink zone metering devices being in said neutral setting during said step (b) to prevent the transfer of ink between the at least one ink fountain roller and the at least one ink transfer roller.

13. The method according to claim 6, wherein said step of performing at least one of said steps (a) and (b) comprises performing only said step (a).

14. The method according to claim 13, wherein the printing press further comprising a blanket washing mechanism disposed adjacent the blanket cylinder for transferring washing liquid to the blanket cylinder to wash the blanket cylinder, means for selectively positioning the blanket cylinder at least into a first, engaged position against the printing plate cylinder and into a second, disengaged position apart from the printing plate cylinder, said method further comprising:

washing the first printing plate, subsequent to said step (a), by:

engaging the blanket cylinder with the printing plate cylinder;

transferring washing liquid between the blanket washing mechanism and the blanket cylinder to wash the blanket cylinder; and transferring washing liquid between the blanket cylinder and the printing plate cylinder to wash the first printing plate disposed on the printing plate cylinder.

15. The method according to claim 14, wherein the printing press further comprises means for selectively positioning the plurality of inking rollers at least into a first, engaged position against the printing plate cylinder and into a second, disengaged position apart from the printing plate cylinder, said method further comprising:

disengaging the plurality of inking rollers from the printing plate cylinder prior to said step of washing the first printing plate.

16. The method according to claim 15, wherein each of the adjustable ink zone metering devices comprises adjustment means for adjusting the adjustable ink zone metering devices, the adjustment means having a neutral setting for causing the ink zone metering devices to prevent the transfer of ink between the at least one ink fountain roller and the at least one ink transfer roller, said method further comprising:

the adjustment means of each of the adjustable ink zone metering devices being in said neutral setting during said step (a) to prevent the transfer of ink between the at least one ink fountain roller and the at least one ink transfer roller.

17. The method according to claim 16, further comprising:

the printing plate being an aluminum plate;

the printing press comprising an intermediate roller for being simultaneously engageable with at least one inking roller and the damping solution applicator roller;

means for selectively positioning the intermediate roller at least into a first, engaged position against the at least one inking roller and the damping solution applicator roller and into a second, disengaged position apart from the at least one inking roller and the damping solution applicator roller;

said step of completely preventing the supply of damping solution to the printing plate comprising the intermediate roller being in said second, disengaged position; and the blanket washing mechanism comprising:

two washing rollers rotatably disposed adjacent the blanket cylinder;

a common roller rotatably and contactingly disposed adjacent each of the two washing rollers;

a transfer roller rotatably and contactingly disposed adjacent a first of said washing rollers;

means for supplying washing liquid to said first washing roller;

said means for supplying washing liquid being a spray apparatus, the spray apparatus being disposed adjacent the first washing roller and being configured to deliver washing liquid to the first washing roller;

a doctor-blade apparatus being disposed adjacent the common roller for removing residues from the common roller; and a collection trough disposed under said doctor-blade apparatus for collecting residues from the common roller; and said step of changing to the subsequent ink zone profile comprising:

adjusting the ink zone metering devices to set the subsequent ink zone profile;

initiating operation of:

the printing plate cylinder;

the plurality of inking rollers;

the at least one ink transfer roller; and the at least on ink fountain roller;

by transferring ink from the ink reservoir to the plurality of inking rollers via a route of travel which extends:

from the ink zone reservoir through at least one of the plurality of individually adjustable ink zone metering devices;

thereafter to the at least one ink fountain roller;

thereafter to the at least one ink transfer roller; and thereafter to the plurality of inking rollers; and establishing the subsequent ink profile on the layer of ink having a constant thickness on the at least one inking roller.

* * * * *

UNITED STATES PATENT AND TRADEMARK OFFICE

CERTIFICATE OF CORRECTION

PATENT NO. : 5,174,210

DATED : December 29, 1992

INVENTOR(S) : Anton RODI and Bernd MÜLLER

It is certified that error appears in the above-indentified patent and that said Letters Patent is hereby corrected as shown below:

In column 4, line 37, after 'ink', delete "matering" and insert --metering--.

In column 19, line 1, Claim 2, before the first occurrence of 'ink', delete "on" and insert --of--.

In column 23, line 21, Claim 7, after 'least', delete "on e" and insert --one--.

In column 23, line 23, Claim 8, after 'wherein', delete "sat" and insert --at--.

In column 23, line 50, Claim 10, after 'printing', delete "pres" and insert --press--.

In column 24, line 28, Claim 14, after 'further', delete "comprising" and insert --comprises--.

Signed and Sealed this

Twenty-sixth Day of April, 1994

Bruce Lehman

*Attest:*

BRUCE LEHMAN

*Attesting Officer*

*Commissioner of Patents and Trademarks*